United States Patent [19]

Forrest et al.

[11] Patent Number: 4,763,486

[45] Date of Patent: Aug. 16, 1988

[54] CONDENSATE DIVERSION IN A REFRIGERATION SYSTEM

[75] Inventors: Scott M. Forrest, San Rafael; Michael R. St. Pierre, Rohnert Park, both of Calif.

[73] Assignee: Marin Tek, Inc., San Rafael, Calif.

[21] Appl. No.: 46,408

[22] Filed: May 6, 1987

[51] Int. Cl.[4] ..... F25B 5/00

[52] U.S. Cl. ..... 62/175; 62/196.4; 62/335

[58] Field of Search ..... 62/335, 196.4, 117, 62/513

[56] References Cited

U.S. PATENT DOCUMENTS 2,682,756 7/1954 Clark et al. ..... 62/335
3,698,202 10/1972 Missimer ..... 62/114
3,768,273 10/1973 Missimer ..... 62/505 X
4,037,426 7/1977 Rojey ..... 62/335 X

*Primary Examiner*—William E. Wayner
*Attorney, Agent, or Firm*—Jay M. Cantor

[57] ABSTRACT

The disclosure relates to a closed refrigeration system wherein refrigerant travelling between heat exchangers in the system is diverted to the evaporator in response to operation of a controller which responds to the temperature at the evaporator. Preferably the diverted refrigerant is the liquid phase thereof, separation of the liquid from the gaseous phase taking place between heat exchangers in a preferred embodiment of the invention. When the temperature at the evaporator is at a predetermined value, the controller can shut off the refrigerant diverting portion of the system to provide standard system operation.

14 Claims, 3 Drawing Sheets

CONDENSATE DIVERSION IN A REFRIGERATION SYSTEM

BACKGROUND OF THE INVENTION

1. Field of the Invention

This invention relates to compression refrigeration systems and, more particularly, to a refrigeration system for producing an extremely wide span of ultra-low and cryogenic temperatures while maintaining reasonable efficiency with an auto refrigerating cascade (ARC) system.

2. Brief Description of the Prior Art

The prior art is exemplified by the patent of Missimer U.S. Pat. Nos. 3,698,202 and 3,768,273. Missimer U.S. Pat. No. 3,768,273 provides a rather complete explanation of the operation of ARC refrigeration systems.

Missimer U.S. Pat. No. 3,698,202 describes a method of bypassing the final throttling device of a full-separation (FS) ARC system for purposes of facilitating start-up of such a system. This method, while effective with FS-ARC systems of two or less cascades, does not allow starting of systems with three or more cascades. This method does not lend itself to very wide temperature span applications. A specific embodiment would be limited to a practical maximum operating span of about 40 degrees C.

Missimer U.S. Pat. No. 3,768,273 describes a system which allows ARC systems of more than two cascades to start. However, the invention does not employ FS. Rather, it relies on partial separation (PS) with condensate carry over to facilitate start-up. The system, while effective, is limited to a practical maximum operating span of about 40 degrees C. and is not particularly fast to start. It is not as efficient as FS-ARC and therefore does not develop as much cooling capacity at any given temperature or get as cold at a given capacity.

A typical PS-ARC system designed to operate down to −140 degrees C. with 100 watts capacity can be operated up to a maximum temperature of −100 degrees C. with 1000 watts capacity. Higher temperature and capacity operation results in excessive operating pressure and temperature at the compressor, risking damage thereto. Warmer temperature operation can be achieved by attenuating the flow of the throttling device which feeds the final evaporator. The method also results in a subtle but serious problem. As the flow of refrigerant is decreased, the average temperature of the final evaporator increases, but the unit supplies colder refrigerant. This colder inlet and higher average temperature results in a large temperature gradient through the evaporator, an unacceptable situation for many applications.

A phenomenon occurs with FS-ARC and, to a lesser extent, with PS-ARC systems known as self-refrigeration. Self-refrigeration occurs when cascades in the middle of the heat exchanger chain become too cold. The refrigerant leaving the over-cooled cascade is mostly condensed and very little refrigerant continues through the phase separator vapor branch to the next cascade. Hold up of liquid in the heat exchangers also contributes to self-refrigeration. The result is that the final throttling device feeds a much reduced quantity of refrigerant to the evaporator. The cooling capacity of the system then falls to almost nothing and may not recover. In milder cases, typically in PS-ARC systems, the cooling capacity is reduced for several minutes until the unit automatically recovers. In both cases, the evaporator temperature rises during the period of reduced cooling capacity.

Self-refrigeration is triggered by quick changes in operating conditions, for example, start-up, rapid defrost or cooling of the evaporator (See Forrest U.S. Pat. No. 4,597,167) or sudden changes in heat load on the evaporator. Self-refrigeration during start-up is the reason simple FS systems do not start. It has been found that self-refrigeration manifests more as the number of cascades is increased. Self-refrigeration is seldon seen with two cascade systems, but affects all three cascade systems to some degree, and is anticipated to be severe with four or more cascade systems.

SUMMARY OF THE INVENTION

It is an object of the present invention to provide a novel improved PS-ARC system which starts faster than prior art PS-ARC refrigeration systems.

It is another object of the present invention to provide a novel improved PS-ARC system for achieving an extremely wide temperature and capacity operating span.

It is another object of the present invention to provide a novel improved PS-ARC system for which self-refrigeration can be controlled.

It is another object of the present invention to provide a novel improved FS-ARC system which automatically and quickly starts.

It is another object of the present invention to provide a novel improved FS-ARC system for achieving an extremely wide temperature and capacity operating span.

It is another object of the present invention to provide a novel improved FS-ARC system for which self-refrigeration can be controlled.

The above and other objects of the present invention are accomplished with a novel ARC system which employs the normal aspects of an ARC system, namely multiple refrigerants, vapor/liquid separation and cascaded heat exchangers.

It has been discovered that by diverting a portion of the condensate developed in the warmer cascades to the final evaporator and by employing any one of several possible means of control, wider temperature ranges can be achieved, quicker cooling is achieved during start-up, FS-ARC systems can be rapidly started and self-refrigeration can be controlled. The expected greater efficiency of the FS system is realized. It is anticipated that FS and PS systems of four or more cascades will also be practical with condensate diversion.

It has been discovered that condensate diverted to the final evaporator can be used to allow a FS-ARC system to operate at much warmer temperatures and also reach colder temperatures than a similar PS-ARC system. The warmer temperature is realized with near optimal increases in refrigeration capacity even though the unit is operating outside the design envelope of the final throttling device. These capabilities are unique among compression cycle refrigeration systems. By diverting directly to the final evaporator a controlled amount of condensate from a warmer separation stage, refrigerant is supplied to the final evaporator which naturally boils at a warmer temperature. More condensate is supplied to the final evaporator because of the combined flows of the condensate diversion and the final throttling device. The greater flow of condensate provides more refrigeration capacity at a higher temperature. A typical condensate diversion FS-ARC system has an operating span from −150 degrees C. with 100 w capacity to −60 degrees C. with 1500 w capacity utilizing substantially the same compressor and heat exchangers as the PS-ARC system described above. The higher maximum temperature and greater capacity result from the condensate diversion invention, and the colder ultimate temperature results from employing FS which can be used because the condensate diversion invention allows the FS system to be rapidly and automatically started.

During the start-up period of a typical PS-ARC it has been found that condensate forms within one to fifteen seconds at the first separation point and typically within one to two minutes at the second separation point, whereas it takes fifteen to twenty five minutes before condensate forms at the final throttling device in significant quantity. The early forming condensate, when diverted to the final evaporator, greatly facilitates start-up in several ways. First, cooling is introduced to the final evaporator and to the cascade heat exchangers nearer the evaporator much sooner, resulting in the formation of condensate in those cascades sooner. Second, high start-up pressures and compression ratios are controlled by the selection of a diversion device which allows a relatively large flow rate when compared to the conventional throttling devices employed in the system. As low temperature operation is achieved, the flow through the diversion device is reduced or halted and normal operation proceeds.

Control of self-refrigeration is achieved three ways. By diverting condensate to the final evaporator, the amount of cooling available to the over-cooled cascade is reduced, it warms up and the fraction of vapor leaving it is increased. The final evaporator is directly cooled by the diverted condensate and the final cascades which were warming because of reduced cooling to the final evaporator are cooled and produce more condensate for the final expansion device. As soon as stable operation resumes, the condensate diversion can be stopped.

BRIEF DESCRIPTION OF THE DRAWINGS

The system of the invention will be further understood by reference to the accompanying drawings wherein:

FIG. 4 is a schematic representation of a hybrid auto refrigerating cascade system having two full separation cascades and one partial separation cascade in accordance with the present invention and, in addition, has fast temperature cycling capability.

Figure 1:
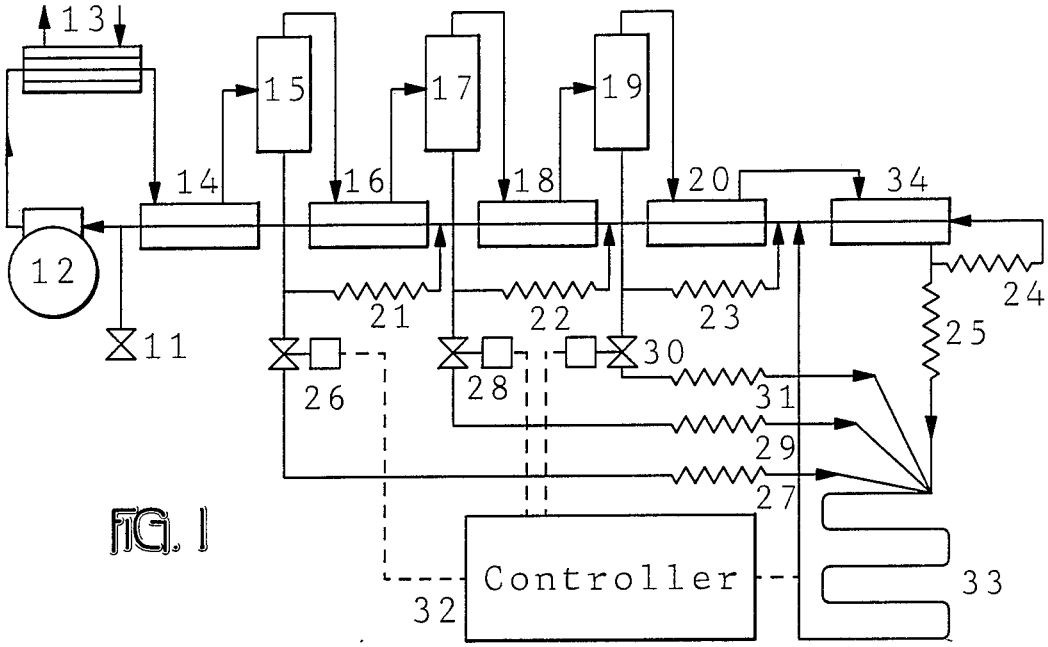
FIG. 1 is a schematic representation of a full separation auto refrigerating cascade system having three cascades in accordance with the present invention.

Referring first to FIG. 1, prior to commencement of operation, the individual refrigerant components are charged in predetermined amounts into the evacuated system.

After charging the system with refrigerant the system is started. The vapors are aspirated by a compressor 12 and pass to the condenser 13 where partial condensation occurs. Condensation occurs by heat exchange with cooling water passing through the condenser. Alternatively, air may be the heat exchange medium. Full condensation does not occur because the refrigerants are selected such that the mixture will not fully condense under the conditions of temperature and pressure in the condenser.

The partially condensed refrigerant flows to the auxiliary condenser 14 where, during steady state operation, further condensation occurs by heat exchange with the cooler suction vapors returning to the compressor 12.

The partially condensed refrigerant flows to the first of several phase separators 15, 17 and 19 where the condensate is separated from the vapors and then to intermediate cascade condensers 16, 18 and 20 where further cooling and condensation occurs. The condensate is rich in those refrigerants which boil at a relatively higher temperature and the vapor is rich in those refrigerants which boil at a relatively lower temperature.

Condensate from the first phase separator 15 is throttled in throttling device 21. Such throttling devices are well known to those skilled in the art and need not be further described herein in great detail. They may consist of capillary tubes, thermal expansion valves, float valves or similar devices which permit throttling of liquid and vapor. When condensate diversion control valve 26 is open, condensate flows to the first diversion throttling device 27. Condensate diversion control valve 26 is controlled by controller 32. The other diversion control valves 28 and 30 and the associated throttling devices 29 and 31 are similarly controlled by the controller 32. The controller 32 is shown monitoring the temperature at the final evaporator 33 and, in response thereto, controlling opening and closing of the control valves 26, 28 and 30 when the appropriate predetermined temperatures are monitored. The controller 32 is a standard prior art device which can be mechanical, electro-mechanical or electronic and need not be further described. It should be noted at this point that, though the preferred embodiment relates to monitoring of the temperature at the final evaporator, the controller 32 could also monitor and/or measure and be responsive to other parameters, such as, for example, temperature, pressure, quasi-superheat, flow, liquid level, mass flow, heat load or a combination of one or more of the the above. Sensing can be at the evaporator or elsewhere. For example, a thermal expansion valve can be used which modulates open or closed, based upon apparent superheat at its bulb location.

A typical control sequence of the apparatus of FIG. 1 for the purpose of facilitating the starting of the system is as follows:

1. The refrigeration system 10 is turned on.
2. The controller 32 senses a warm final evaporator 33 (e.g., +20 degrees C.) and opens valves 26, 28 and 30.
3. Condensate flows to the final evaporator 33 initially through throttle 27.
4. Shortly thereafter as heat exchangers 14 and 16 cool down, condensate flows to the final evaporator 33 through throttle 29 also.
5. The controller 32 senses the final evaporator 33 cooling to 0 degrees C. and closes valve 26.
6. Heat exchangers 18 and 20 are cooled by returning refrigerant from the final evaporator 33.
7. Condensate starts to form and flow to the final evaporator 33 through throttle 31.

8. The controller 32 senses the final evaporator 33 cooling to −60 degrees C. and closes valve 28.
9. Condensate starts to form in heat exchangers 20 and 34. It flows through throttles 24 and 25, cooling heat exchanger 34 more than heat exchanger 20 and cooling the final evaporator 33.
10. The controller 32 senses the final evaporator 33 cooling to −100 degrees C. and closes valve 30. The system now functions as a conventional FS-ARC system and continues to cool to the ultimate temperature of −150 degrees C.

Utilizing the same equipment as shown in FIG. 1, a typical control sequence for the purpose of providing an extremely wide temperature and capacity operating span for the system is as follows:

1. The system 10 is started and reaches a steady state operating condition in the manner described above in about 30 to 60 minutes.
2. A thermal load is gradually introduced and, as a consequence, the final evaporator 33 temperature starts to rise. The refrigeration system 10 responds with increased suction and discharge pressure and corresponding higher refrigerant flow rates at all parts of the system.
3. The thermal load is increased still further and the refrigeration system 10 continues to respond as in 2. above, i.e., operates at higher pressures and flow rates. However, the maximum flow rates of the throttling devices are approached and the system's capacity starts to level off. At lower loads, the final evaporator 33 temperature changes substantially linearly with thermal load, but as the maximum flow rates of the throttling devices are approached, the final evaporator 33 temperature starts to rise sharply with small increases in thermal load.
4. As the thermal load is increased further, the final evaporator 33 temperature rises sharply to −90 degrees C. and the controller 32 opens valve 30.
5. Condensate flows to the final evaporator 33 through throttle 31 and stabilizes the final evaporator 33 temperature at −95 degrees C. The compressor discharge pressure then decreases about 20 psi and the suction pressure rises about 3 psi because of the reduced flow impedance with the opening of the diversion path of the system.
6. The thermal load is increased still further and the refrigeration system 10 responds as above in 2 in the start up example. But now, with the diversion valve 30 open, the system has more total flow capacity and can respond to the increased load with increased capacity. The consequence is that the final evaporator 33 temperature changes in a fixed ratio with thermal load as it did at the lower thermal load.
7. As thermal load is increased further, the other condensate diversion valves are opened at specific evaporator temperatures chosen to coincide with the system reaching a new maximum throttle flow capacity.

Figure 2:
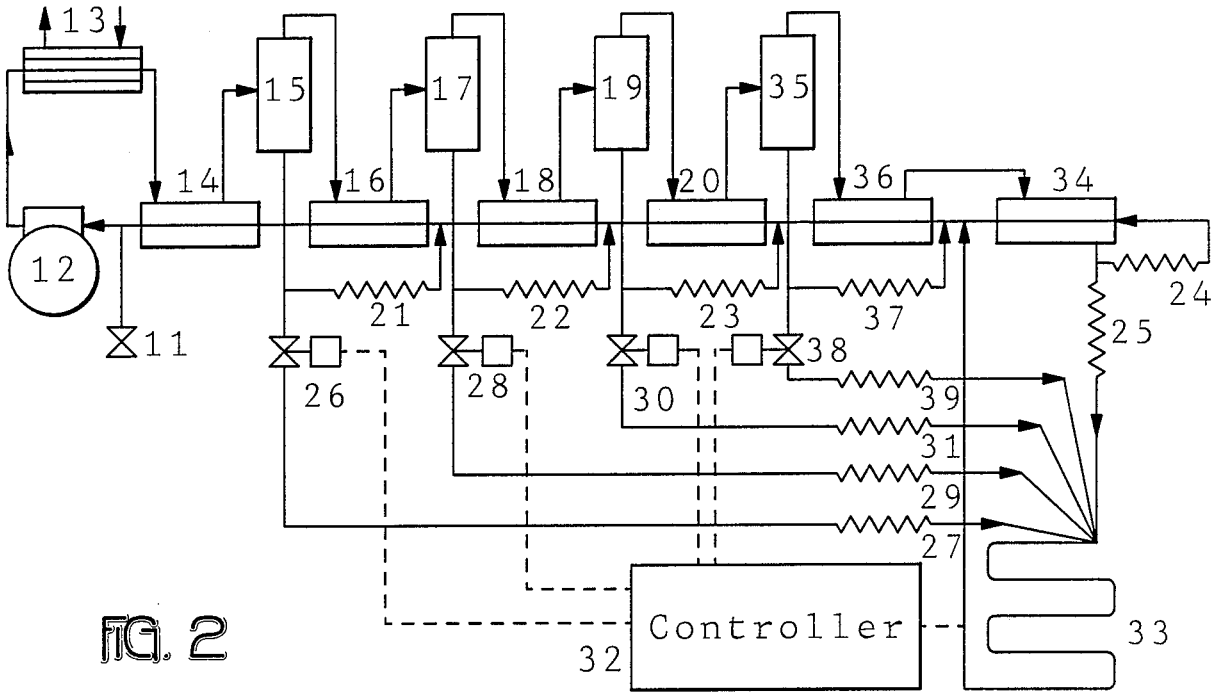
FIG. 2 is a schematic representation as in FIG. 1 but having four cascades.

The system 100 of FIG. 2 is identical to that of FIG. 1 and utilizes like reference numerals for like parts. System 100 adds a further cascade stage composed of an additional separator 35, an additional heat exchanger 36, and additional throttling device 37, and additional control valve 38 controlled by the controller 32 and an additional throttling device 39 from the valve 38 to the final evaporator 33. The system 100 operates the same as the system 10 of FIG. 1 except that there is provided an additional stage of control and refrigeration.

Figure 3:
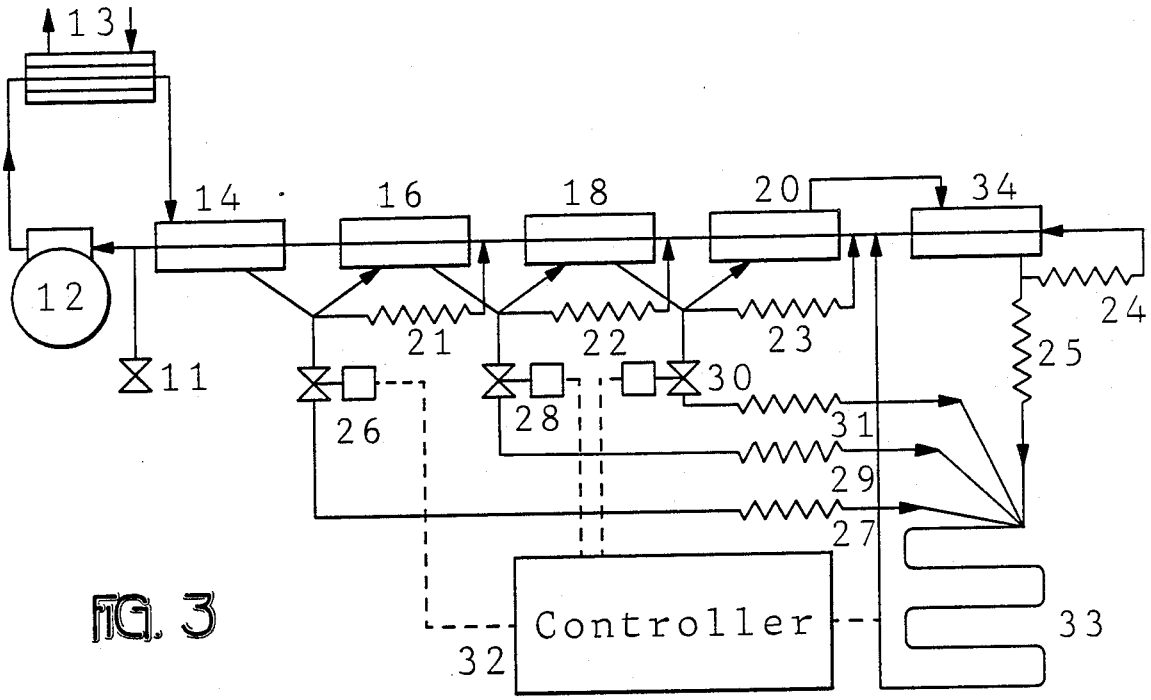
FIG. 3 is a schematic representation of a partial separation auto refrigerating cascade system having three cascades in accordance with the present invention.
Figure 3:
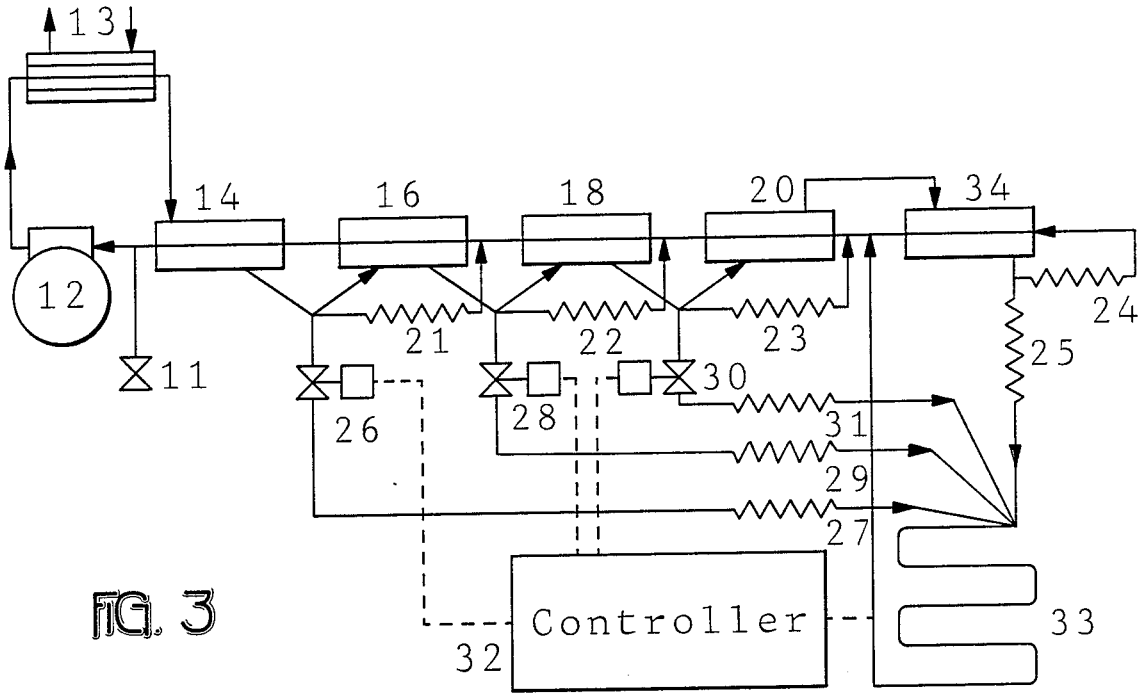

The system 1000 of FIG. 3 is similar to that of FIG. 1 except that it is a PS-ARC rather than and FS-ARC system and wherein like reference numerals are utilized for like parts. It can be seen that the systems of FIGS. 1 and 3 are identical except for replacement of the separators 15, 17 and 19 of FIG. 1 with direct lines to the control 26, 28 and 30 and the adjacent heat exchangers. The system otherwise will operate in the manner described hereinabove for the system 10 of FIG. 1.

The system 10000 of FIG. 4 is a hybrid system and utilizes the same part numbers for the same parts as in the systems 10 of FIG. 1 and 1000 of FIG. 3. It can be seen that the systems are identical except for the replacement of separator 19 with a direct line from heat exchanger 18 to heat exchanger 20 via control valve 30. In addition, the control valve 26 and throttling device 27 therefrom to the final evaporator 33 has been removed. The system of FIG. 4 also includes a defrost system which includes a heat exchanger 41 in the line between the compressor 12 and the heat exchanger 13. The heat exchanger 41 is connected to the final evaporator 33 via a defrost line 43 and valve 42 with the return path to the heat exchanger 41 being from the input to heat exchanger 20. Also, a valve 40 is disposed in the line from throttle 25 to the final evaporator 33.

For cooling, the valve 42 will be closed and the valve 40 will be open. For defrost, the valve 42 will be open and the valve 40 will be closed. Otherwise, the system of FIG. 4 operates in the same manner as that of FIG. 1.

A typical control sequence, the purpose of which is prevention of self-refrigeration for the system is as follows:

1. Self-refrigeration is triggered by two different operating sequences on a running system. The first is the initiation of a quick cooling cycle. System 10000 of FIG. 4 is equipped for quick cooling. The system 10000 is defrosted by means of closing valve 40 and opening valve 42 for a sufficient period of time. The final evaporator 33 can be brought to room temperature without turning off the refrigeration system. Initiation of quick cooling by opening valve 40 triggers the controller 32 to go through a sequence like that of startup by opening valves 28 and 30, reclosing then in sequence as the final evaporator 33 cools and thereby preventing a self-refrigeration incident. Such an incident would cause the final evaporator 33 to warm up after initial quick cooling and then to slowly recool or it may not recool.
2. The second triggering operating sequence is a sudden load increase. In system 10 of FIG. 1 a self-refrigeration incident will cause the final evaporator 33 to warm up excessively and then gradually recool or it may not recool. The controller 32 will respond as described for a high load condition by opening valve 30. The final evaporator 33 temperature will be brought under immediate control. If the load is low enough, the final evaporator 33 will cool to the point where the controller 32 will close valve 30.

It can be seen that there has been provided a refrigeration system which accomplishes the above described objects in simple manner.

Though the invention has been described with respect to specific preferred embodiments thereof, many variations and modifications will immediatly become apparent to those skilled in the art. It is therefore the intention that the appended claims be interpreted as broadly as possible in view of the prior art to include all such variations and modifications.

We claim:

1. A refrigeration system comprising:

(a) a closed loop refrigeration circuit having, in serially connected relation, a compressor, a plurality of cascaded heat exchangers and an evaporator, and a vapor/liquid refrigerant passing in said closed loop from said compressor to said heat exchanger and then to said evaporator and then back to said compressor;

(b) control valve means for diverting liquid refrigerant passing between an adjacent pair of said heat exchangers to said evaporator; and (c) control means responsive to a predetermined variable condition of said system to control operation of said control valve means in a predetermined manner.

2. A refrigeration system as set forth in claim 1 wherein said system further includes phase separator means for separating gaseous refrigerant from liquid refrigerant passing between at least one adjacent pair of said heat exchangers and passing the liquid refrigerant to said control valve means.

3. A refrigeration system as set forth in claim 1 wherein said condition is the temperature at said evaporator.

4. A refrigeration system as set forth in claim 2 wherein said condition is the temperature at said evaporator.

5. A refrigeration system as set forth in claim 1 wherein said refrigeration circuit includes at least three heat exchangers, said control valve means includes a separate control valve between each adjacent pair of heat exchangers and said control means includes means to control each of said control valves independently.

6. A refrigeration system as set forth in claim 5 wherein said condition is the temperature at said evaporator.

7. A refrigeration process comprising:

(a) providing a closed loop refrigeration circuit having, in serially connected relation, a compressor, a plurality of cascaded heat exchangers and an evaporator, and a vapor/liquid refrigerant passing in said closed loop from said compressor to said heat exchanger and then to said evaporator and then back to said compressor;

(b) providing at least one control valve for diverting liquid refrigerant passing between at least one adjacent pair of said heat exchangers to said evaporator;

(c) sensing a predetermined variable condition of said system; and (d) controlling operation of said at least one control valve in a predetermined manner in response to said sensed variable condition.

8. A refrigeration process as set forth in claim 7 wherein said variable is the temperature at said evaporator.

9. A refrigeration process as set forth in claim 7 further including separating gaseous refrigerant from liquid refrigerant passing between said at least one adjacent pair of said heat exchangers and passing the liquid portion of said separated refrigerant to said at least one control valve.

10. A refrigeration process as set forth in claim 8 further including separating gaseous refrigerant from liquid refrigerant passing between said at least one adjacent pair of said heat exchangers and passing the liquid portion of said separated refrigerant to said at least one control valve.

11. A refrigeration method as set forth in claim 7 further including providing at least three heat exchangers, a separate control valve between each adjacent pair of heat exchangers and controlling each of said control valves independently.

12. A refrigeration method as set forth in claim 8 further including providing at least three heat exchangers, a separate control valve between each adjacent pair of heat exchangers and controlling each of said control valves independently.

13. A refrigeration method as set forth in claim 9 further including providing at least three heat exchangers, a separate control valve between each adjacent pair of heat exchangers and controlling each of said control valves independently.

14. A refrigeration method as set forth in claim 10 further including providing at least three heat exchangers, a separate control valve between each adjacent pair of heat exchangers and controlling each of said control valves independently.

* * * * *